US006457949B1

(12) United States Patent
Bendikas et al.

(10) Patent No.: US 6,457,949 B1
(45) Date of Patent: Oct. 1, 2002

(54) FAN TRAY APPARATUS AND METHOD

(75) Inventors: Laura M. Bendikas, Chicago; Daniel J. Lecinski, Arlington Heights; Hong Li, Carol Stream; Dane L. Greives, Buffalo Grove; Kenneth S. Laughlin, Arlington Heights, all of IL (US)

(73) Assignee: 3Com Corporation, Rolling Meadows, IL (US)

( * ) Notice: Subject to any disclaimer, the term of this patent is extended or adjusted under 35 U.S.C. 154(b) by 0 days.

(21) Appl. No.: 09/765,808

(22) Filed: Jan. 18, 2001

(51) Int. Cl.[7] ..... F04B 17/03

(52) U.S. Cl. ..... 417/360; 415/193; 415/219.1; 417/423.5; 361/688

(58) Field of Search ..... 417/360, 423.5, 417/423.7; 415/60, 193, 119, 219.1; 361/690, 692, 695, 688

(56) References Cited

U.S. PATENT DOCUMENTS 4,767,262 A * 8/1988 Simon ..... 415/119
4,789,351 A * 12/1988 Fisher, Jr. et al. ..... 439/248
4,931,904 A * 6/1990 Yiu ..... 361/384
5,484,262 A * 1/1996 Thomas et al. ..... 415/178
5,788,467 A * 8/1998 Zenitani et al. ..... 417/360
5,927,389 A * 7/1999 Gonsalves et al. ..... 165/121
5,949,646 A * 9/1999 Lee et al. ..... 361/695
6,011,689 A * 1/2000 Wrycraft ..... 361/695
6,234,817 B1 * 5/2001 Hwang ..... 439/247

* cited by examiner

*Primary Examiner*—Charles G. Frea
*Assistant Examiner*—Han Lieh Liu
(74) *Attorney, Agent, or Firm*—Baniak Pine & Gannon

(57) ABSTRACT

A fan tray apparatus and method includes a mounting body portion having a length and a width. The mounting body portion further includes first and second longitudinal sides and first and second lateral sides. A plurality of fans is operatively attached to the mounting body portion. The plurality of fans includes a first set of fans, a second set of fans, and a third set of fans. The first set of fans is positioned along the first lateral side. The second set of fans is positioned along the second lateral side. The third set of fans is positioned between the first set of fans and the second set of fans, the third set of fans positioned on a middle portion of mounting body portion.

21 Claims, 3 Drawing Sheets

FAN TRAY APPARATUS AND METHOD

FIELD OF THE INVENTION

The present invention relates to a fan tray assembly for use in an electronic chassis and, in particular, to a fan tray apparatus and method for cooling electronic devices housed within the electronic chassis.

BACKGROUND OF THE INVENTION

Conventional electronic chassis used for high-speed switching and networking applications typically are comprised of a metallic box-shaped card cage. Numerous circuit board modules (otherwise known as application cards) are slid into the electronic chassis along card guide assemblies, and are electrically attached to a backplane circuit board located along the backside of the chassis.

Each application card typically includes a large number of electronic components. As a result, these application cards generate a tremendous amount of heat, which must be removed from the chassis to protect the various electronic components within the chassis. As a result, conventional fans have been used to bring cooling air into the chassis, and, at the same time, to exhaust heated air from the chassis.

Various attempts have been made to reduce the temperature within an electronic chassis by providing a fan tray assembly, which includes one or more conventional fans. The fan tray assembly may then be housed within the chassis along the top portion of the chassis. Cool air is circulated upward from the bottom of the chassis, through the chassis between the card guide assemblies, and the heated air is exhausted out through the top of the chassis.

Electronic chassis typically have strict dimensional requirements. As a result, the size and orientation of the fans is critical to maximize the amount of airflow through the chassis. Conventional fan tray assemblies, however, typically have several drawbacks. For example, in an effort to increase the output of the cooling ability of the fans, which is necessary to prevent overheating of the electronic component within the chassis, most conventional designs have relied on the "bigger is better" premise, and have increased the size of the fans themselves. However, this results in other problems, including an increase in the required space within the chassis (which is typically not feasible), an increase in the weight of the chassis beyond acceptable limits, an increase in the number of parts, and an increase in the cost of production.

Moreover, conventional fan tray assemblies typically do not provide the optimum orientation of the fans within the tray to maximize the airflow through the chassis. The layout of the fans within the fan tray is typically extremely important to minimize "dead air" zones within the chassis, and to supply adequate airflow to the higher impedance areas within the chassis, such as along the sides of the chassis and along the backplane circuit board.

Accordingly, it would be desirable to provide a fan tray apparatus and method that overcomes the disadvantages described above.

SUMMARY OF THE INVENTION

One aspect of the invention provides a fan tray apparatus including a mounting body portion having a length and a width. The mounting body portion further includes first and second longitudinal sides, and first and second lateral sides. A plurality of fans is operatively attached to the mounting body portion. The plurality of fans includes a first set of fans, a second set of fans, and a third set of fans. The first set of fans is positioned along the first lateral side, the second set of fans is positioned along the second lateral side, and the third set of fans is positioned between the first set of fans and the second set of fans. The third set of fans is positioned on a middle portion of mounting body portion. The third set of fans may preferably be spaced apart from the first set of fans a distance that is equal to a distance between the third set of fans and the second set of fans. The third set of fans may preferably be spaced apart from the first longitudinal side and the second longitudinal side. The first set of fans may preferably be comprised of at least three fans, the second set of fans may preferably be comprised of at least three fans, and the third set of fans may preferably be comprised at least two fans. The first and second set of fans may each be comprised of three fans, and the second set of fans may be comprised of two fans. Each of the plurality of fans may preferably be identical. Each of the plurality of fans may preferably include a length, a width, and a height. The length of each of the plurality of fans may preferably be 120 millimeters, the width of each of the plurality of fans may preferably be 120 millimeters, and the height of each of the plurality of fans may preferably be 38 millimeters.

A first circuit board may preferably be positioned on the mounting body portion along the second longitudinal side between the first, second, and third sets of fans. The first circuit board may preferably include redundant DC/DC converters. A controller printed circuit board for controlling the plurality of fans may preferably be positioned on the mounting body portion along the first longitudinal side between the first, second, and third sets of fans. A through opening may preferably extend through the first longitudinal side, and a connector may preferably extend through the opening and may preferably be attached to the first longitudinal side. The connector may preferably be electrically connected to the plurality of fans. The connector may preferably be a floating-blind mate connector. The second longitudinal side may preferably include a pair of manually operable latches. The mounting body portion may preferably include a plurality of grated openings wherein the plurality of grated openings is aligned with the plurality of fans. The mounting body portion may preferably include a plurality of mounting body portion fastener openings spaced apart along the first longitudinal side and the first and second lateral sides. A cover portion may also be provided, which is mounted to the mounting body portion. The cover portion may preferably include a plurality of cover fastener openings spaced apart along a perimeter portion of the cover portion wherein the cover fastener openings are aligned with the mounting body portion fastener openings. The cover portion may preferably include a plurality of fan openings that are aligned with the plurality of fans. Each of the plurality of fan openings may preferably be is circular.

Another aspect of the invention provides a method of orienting a fan tray. A mounting body portion having a length and a width is provided. The mounting body portion includes first and second longitudinal sides and first and second lateral sides. A plurality of fans is also provided. The plurality of fans includes a first set of fans, a second set of fans, and a third set of fans. The plurality of fans is attached to the mounting body portion. The first set of fans is positioned along the first lateral side, and the second set of fans is positioned along the second lateral side. The third set of fans is positioned between the first set of fans and the second set of fans. The third set of fans is positioned on a middle portion of the mounting body portion.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and the equivalents thereof.

DETAILED DESCRIPTION OF THE PRESENTLY PREFERRED EMBODIMENTS

Figure 5:
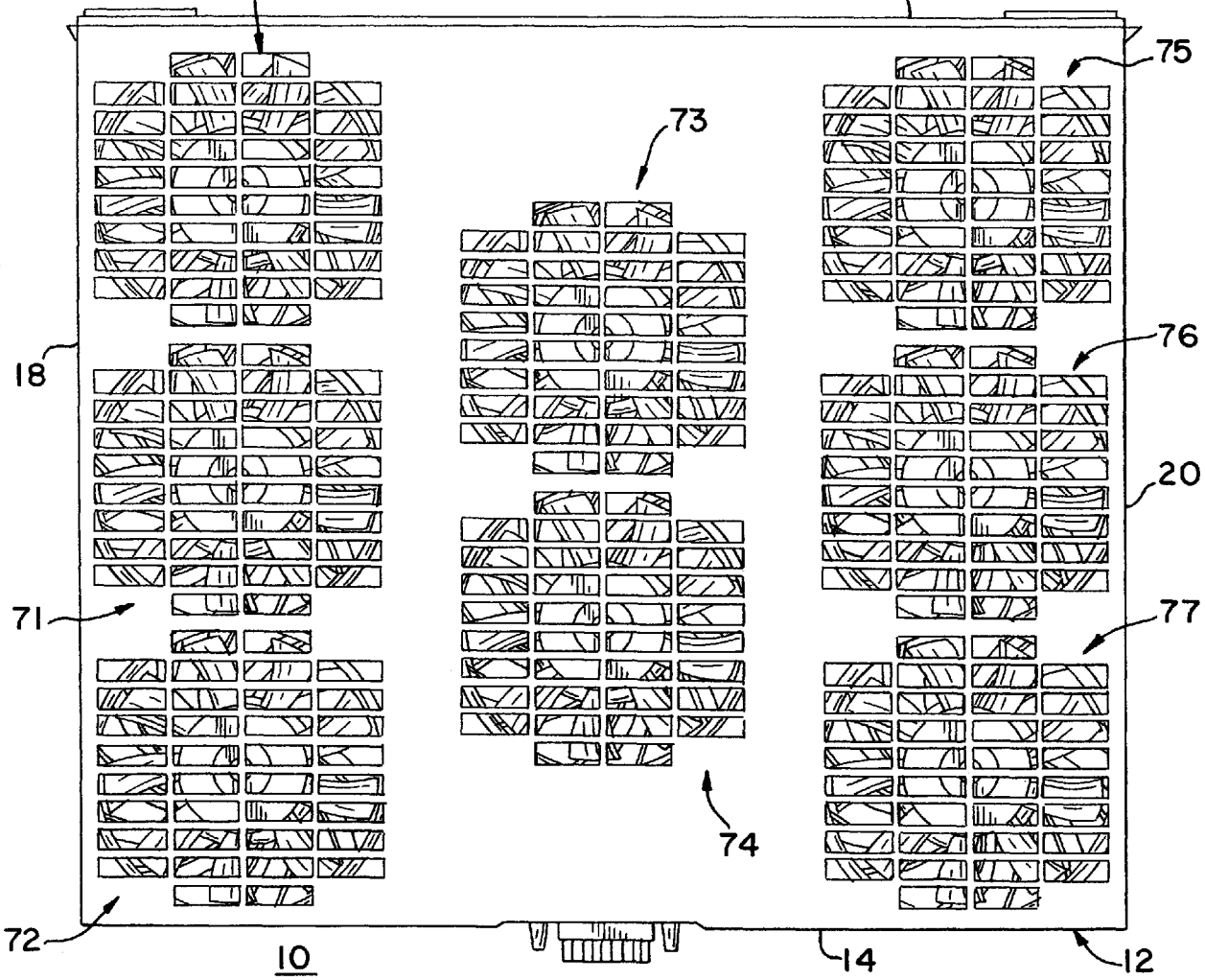
FIG. 5 is a back view of the embodiment of FIG. 1.
Figure 6:
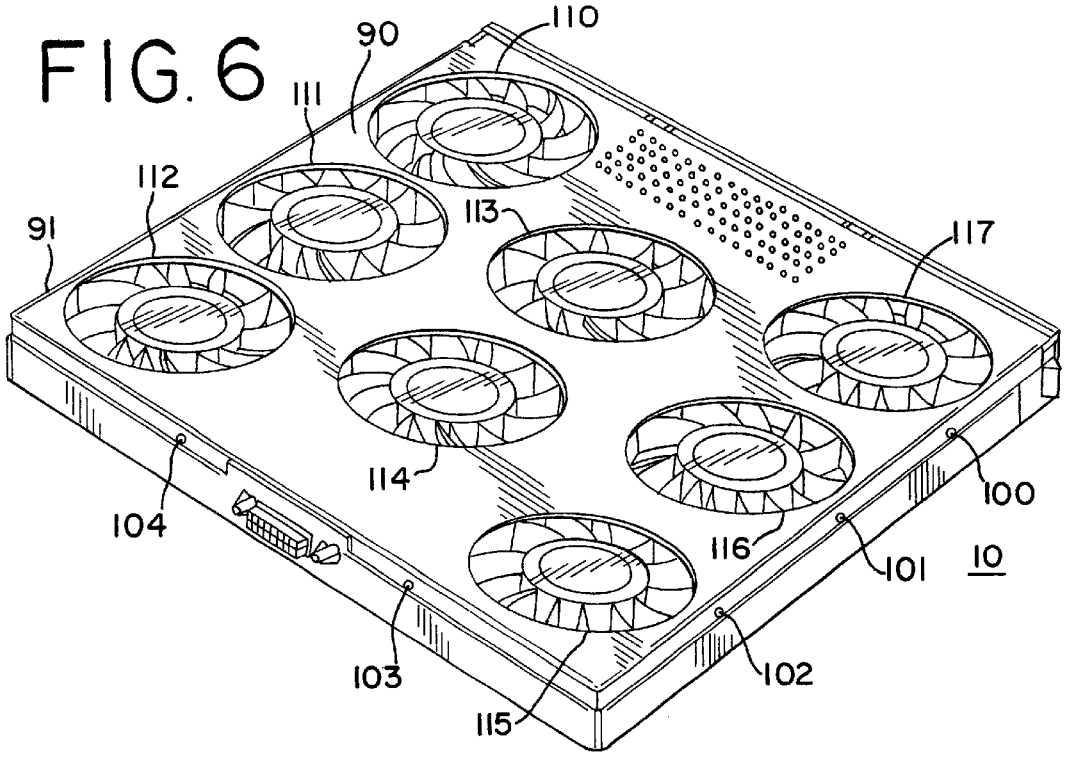
FIG. 6 is a front perspective view of the embodiment of FIG. 1.
Figure 7:
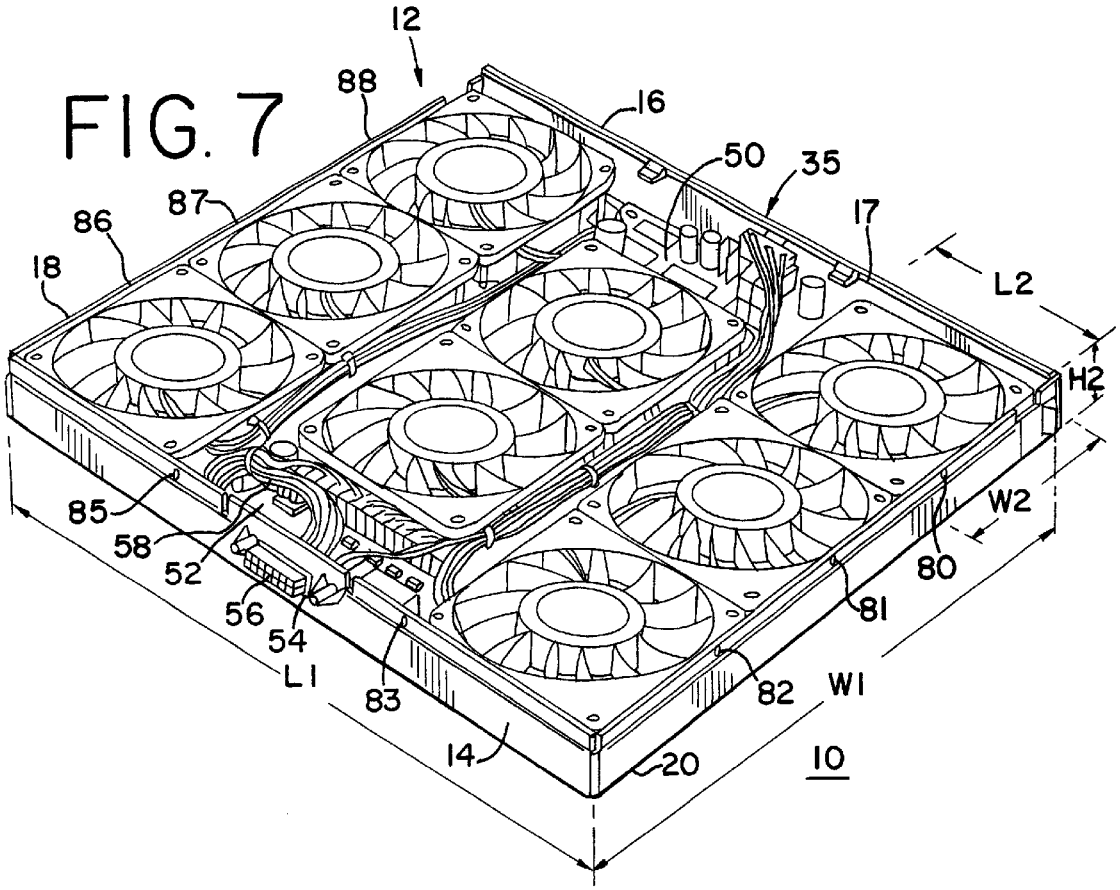
FIG. 7 is a front perspective view of the embodiment of FIG. 1, shown without the top cover portion.

Referring to FIGS. 1–7, reference numeral 10 represents a preferred embodiment of a fan tray apparatus. As shown in FIG. 7, the fan tray apparatus 10 includes a mounting body portion 12 having a length L1 and a width W1. The mounting body portion 12 further including first and second longitudinal sides 14, 16, and first and second lateral sides 18, 20. In the embodiment shown, the two lateral sides 18, 20 are disposed on opposing parallel ends of the mounting body portion 12 perpendicular to the two longitudinal sides 14, 16.

Figure 1:
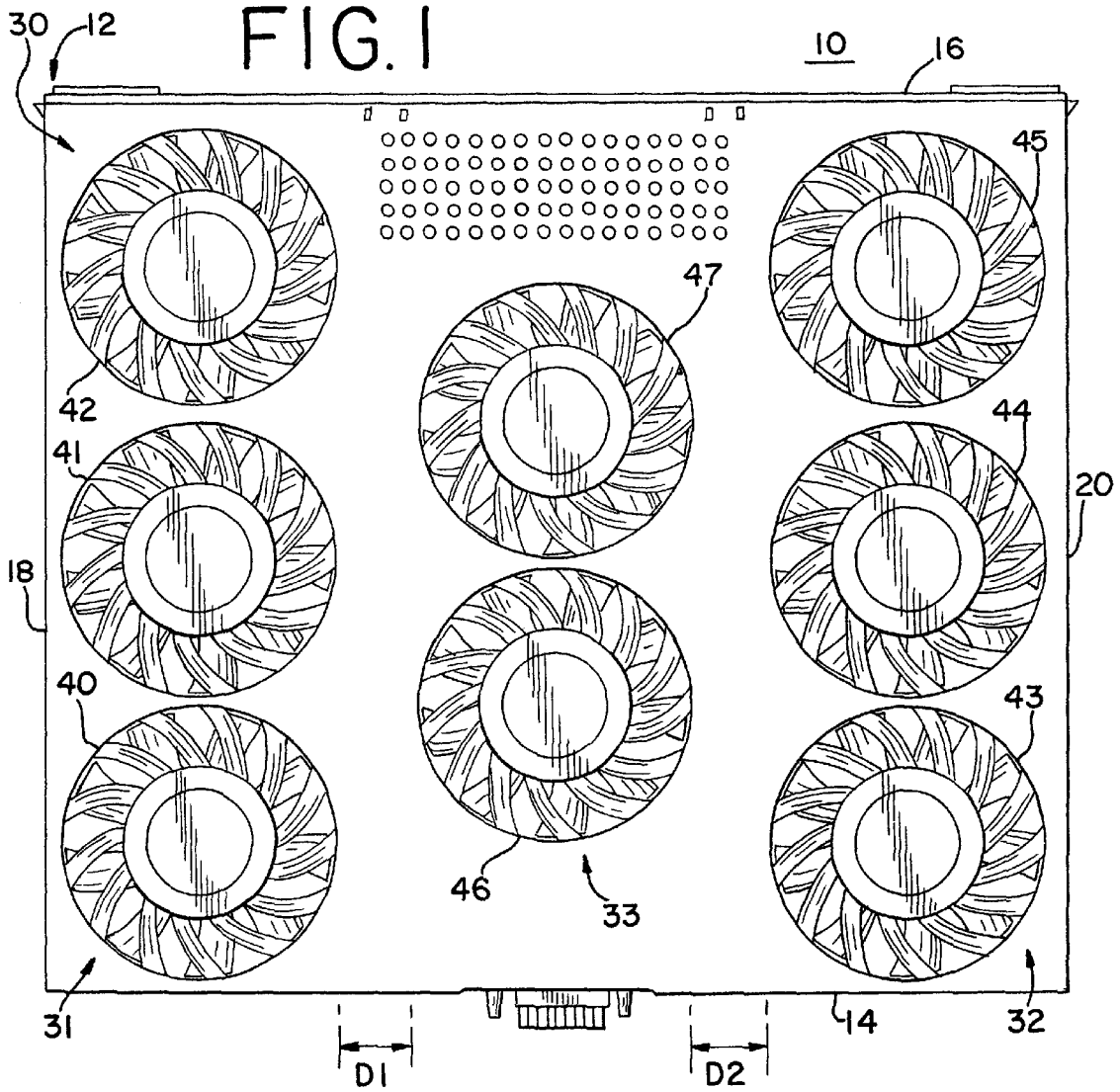
FIG. 1 is a front view of a preferred embodiment of a fan tray apparatus made in accordance with the invention.

Referring to FIGS. 1 and 7, a plurality of fans 30 is operatively attached to the mounting body portion 12. Referring to FIG. 1, the plurality of fans 30 includes a first set of fans 31, a second set of fans 32, and a third set of fans 33. The first set of fans 31 may preferably include at least three fans 40, 41, 42. Similarly, the second set of fans 32 may preferably include at least three fans 43, 44, 45. Finally, the third set of fans 33 may preferably include at least two fans 46, 47.

As shown in FIG. 1, the first set of fans 31 is positioned along the first lateral side 18 of the mounting body portion 12. In the embodiment shown, for example, the fans 40, 41, and 42 are arranged end-to-end in a linear fashion. The second set of fans 32 is positioned opposite the first set of fans 31 along the second lateral side 20 of the mounting body portion 12. In the embodiment shown, for example, fans 43, 44, and 45 are arranged end-to-end in a linear fashion. The third set of fans 33 is positioned between the first set of fans 31 and the second set of fans 32. In the embodiment shown, the third set of fans 33 is positioned on a middle portion 35 of the mounting body portion 12. In the embodiment shown, for example, the fans 46 and 47 are arranged end-to-end in a linear fashion. As shown in FIG. 1, the third set of fans 33 may preferably be spaced apart from the first set of fans 31 a distance D1 that is equal to a distance D2 between the third set of fans 33 and the second set of fans 32. The third set of fans 33 may also be spaced apart from the first longitudinal side 14 and the second longitudinal side 16. Positioning the first, second, and third sets of fans 31, 32, 33 in three separate columns in this fashion (i.e. 3-2-3 orientation) maximizes the amount of airflow through the chassis (not shown), especially in high impedance areas within the chassis, such as, for example, along the sides of the chassis and along the backplane of the chassis (not shown).

As shown in FIG. 7, each of the plurality of fans 30 includes a length L2, a width W2, and a height H2. The length L2 of each of the plurality of fans 30 may preferably be 120 millimeters, the width W2 of each of the plurality of fans 30 may preferably be 120 millimeters, and the height H2 of each of the plurality of fans 30 may preferably be 38 millimeters. Each of the plurality of fans 30 may preferably have the identical configuration, which simplifies the assembly process thereby reducing costs. The fans 30 may preferably be any conventional fans such as, for example, any direct current brushless fan such as the one manufactured by Delta Electronics, Inc., model number FFB1248SHE. The fans 30 may preferably be fastened to the body mounting portion 12 with any conventional fastener such as, for example, screws, bolts, or rivets, etc.

The mounting body portion 12 can be made out of any rigid material, but will preferably be made out of a metallic material, such as, for example, sheet metal, aluminum, stainless steel, etc. The mounting body portion 12 provides the base for the fan tray apparatus 10. In the embodiment shown, the mounting body portion 12 has a generally square shape, although other shapes and configurations are contemplated. In the embodiment shown, for example, the length L1 of the mounting body portion is approximately 17.250 inches, and the width W1 is approximately 15 inches.

Referring again to FIG. 7, a first circuit board 50 may preferably be positioned on the mounting body portion 12 along the second longitudinal side 16 between the first, second, and third sets of fans 31, 32, 33. The first circuit board 50 may preferably include redundant DC/DC converters. The redundant DC/DC converters may preferably be any conventional dual-redundant DC/DC converter. The first circuit board 50 may preferably be positioned along the second longitudinal side 16 (i.e. front side) of the mounting body portion 12 at or near the midpoint between the first and second lateral sides 18, 20 of the mounting body portion 12 to minimize the additional heat that may be generated along the backplane circuit board of the chassis (not shown). The placement of the first circuit board 50 in this location provides an efficient means of thermal dissipation within the fan tray apparatus 10.

A controller printed circuit board 52 may preferably be positioned on the mounting body portion 12 along the first longitudinal side 14 between the first, second, and third sets of fans 31, 32, 33. The controller printed circuit board 52 communicates with the chassis (not shown) and controls and regulates the speed of the plurality of fans 30. As shown in FIG. 7, the controller printed circuit board 52 is positioned opposite the first circuit board 50 along the first longitudinal side 14 (i.e. rear side) of the mounting body portion 12 at or near the midpoint between the first and second lateral sides 18, 20 of the mounting body portion 12. The placement of the controller printed circuit board 52 in this fashion minimizes the length of the communication cables to the chassis (not shown). Positioning the first circuit board 50 and the controller printed circuit board 52 in this spaced-apart fashion on the mounting body portion 12 minimizes electromagnetic interference ("EMI") that may be interfere with the operation of the controller printed circuit board 52 and any outbound communication signals.

Referring again to FIG. 7, a through connector opening 54 may preferably extend through the first longitudinal side 14 of the mounting body portion 12. A connector 56 may preferably be adapted to extend through the connector opening 54 and may preferably be attached to the first longitudinal side 14. The connector 56 provides an interface to allow electric current to be delivered to the fan tray apparatus 10. In the embodiment shown, the connector 56 is positioned at or near the midpoint between the first and second lateral sides 18, 20 of the mounting body portion 12. The connector 56 is electrically connected to the plurality of fans 30 via the controller printed circuit board 52 by a plurality of cables or wires 58. The connector 56 may preferably be a floating-blind mate connector to provide automatic alignment of the fan tray apparatus 10 during installation of the fan tray apparatus 10 into the chassis (not shown). The connector 56 may preferably include staggered pin lengths (i.e. first mate-last break) to enable hot-swap insertion of the fan tray assembly 10 into the chassis (not shown). An electric current used to power the fans 30 is preferably transmitted through the connector 56, the cables 58 and ultimately to the fans 30 themselves. Similarly, an electric current used to power the redundant DC/DC converters on the first circuit board 50 is preferably transmitted through the connector 56, through the controller printed circuit board 52 and ultimately to the DC/DC converters themselves via cables 58.

Figure 2:
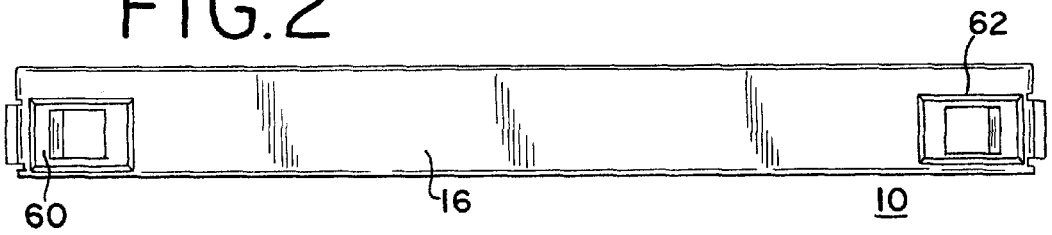
FIG. 2 is a top view of the embodiment of FIG. 1.
Figure 3:
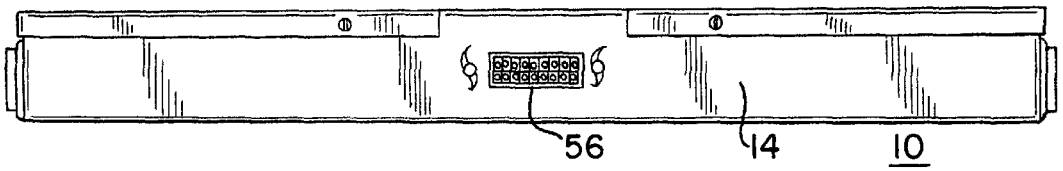
FIG. 3 is a bottom view of the embodiment of FIG. 1.

Referring to FIG. 2, the second longitudinal side 16 of the mounting body portion 12 may preferably include a pair of manually operable latches 60, 62. The latches 60, 62 may preferably be any conventional latches to enable the fan tray apparatus 10 to be firmly secured to the chassis when the fan tray apparatus 10 is installed in the chassis. In particular, the latches 60, 62 are preferably spring-loaded, and are positioned into openings (not shown) in the second longitudinal side 16 of the mounting body portion 12.

As shown in FIG. 5, the mounting body portion 12 includes a plurality of grated openings 70, 71, 72, 73, 74, 75, 76, and 77, which are aligned with the plurality of fans 30. The shape and configuration of the grated openings 70, 71, 72, 73, 74, 75, 76, and 77 may vary depending upon the particular application. The grated openings 70, 71, 72, 73, 74, 75, 76 provide finger protection for the technician, while at the same time, allow air to move freely through the fan tray apparatus 10 to reduce the operating temperature inside of the electronic chassis (not shown).

Referring again to FIG. 7, the mounting body portion 12 may preferably include a plurality of mounting body portion fastener openings 80, 81, 82, 83, 84, 85, 86, and 87 spaced apart along the first longitudinal side 14 and the first and second lateral sides 18, 20. The plurality of mounting body portion fastener openings 80, 81, 82, 83, 84, 85, 86, and 87 allow a top cover portion 90 to be fixedly attached to the mounting body portion 12.

Figure 4:
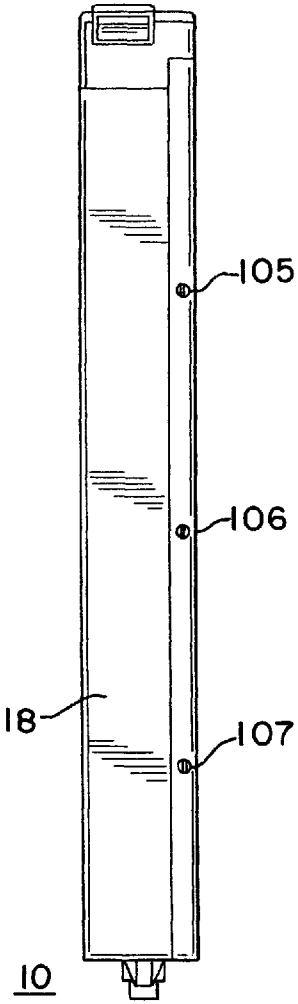
FIG. 4 is a side view of the embodiment of FIG. 1.

As shown in FIGS. 4 and 6, a top cover portion 90 may preferably include a plurality of cover fastener openings 100, 101, 102, 103, 104, 105, 106, and 107 spaced apart along a perimeter portion 91 of the top cover portion 90. The cover fastener openings 100, 101, 102, 103, 104, 105, 106, and 107 are aligned with the mounting body portion fastener openings 80, 81, 82, 83, 84, 85, 86, and 87 to allow the cover portion 90 to be fastened to the mounting body portion 12. In particular, the top cover portion 90 may preferably be operatively attached, preferably through the use of screws, to the first longitudinal side 14, the first lateral side 18 and the second lateral side 20 of the mounting body portion 12. The top cover portion 90 is also operatively attached to the second longitudinal side 16, preferably by sliding underneath a lip portion 17 (see FIG. 7) of the second longitudinal side 16.

As shown in FIG. 6, the cover portion 90 may preferably include a plurality of fan openings 110, 111, 112, 113, 114, 115, 116, and 117. The plurality of fan openings 110, 111, 112, 113, 114, 115, 116, and 117 may preferably be aligned with the plurality of fans 30. In the embodiment shown, for example, each of the fan openings 110, 111, 112, 113, 114, 115, 116, and 117 is circular, and mirror the shape of the fans 30. The fan openings 110, 111, 112, 113, 114, 115, 116, and 117 of the cover portion 90 allow air to pass through the fan tray apparatus 10 to reduce the temperature inside of the electronic chassis.

The fan tray apparatus 10 may preferably be configured to provide the maximum amount of airflow through an electronic chassis (not shown). Referring to FIGS. 1–7, the plurality of fans 30 is attached to the mounting body portion 12. In particular, the first set of fans 31 is positioned along the first lateral side 18 of the mounting body portion 12. In the embodiment shown, fans 40, 41, and 42 are arranged end-to-end in a linear fashion. The second set of fans 32 is positioned along the second lateral side 20 of the mounting body portion 12. In the embodiment shown, the fans 43, 44, and 45 are arranged end-to-end in a linear fashion. Finally, the third set of fans 33 is positioned between the first set of fans 31 and the second set of fans 32. In the embodiment shown, fans 46 and 47 are arranged end-to-end in a linear fashion 35. The third set of fans 33 is positioned on a middle portion 35 of the mounting body portion 12. The fans 30 are fixedly attached to the mounting portion 12.

A first circuit board 50 having the redundant DC/DC converters is positioned on the mounting body portion 12 along the second longitudinal side 16 between the first, second, and third sets of fans 31, 32, 33. A controller printed circuit 52 board is positioned on the mounting body portion 12 along the first longitudinal side 14 between the first, second, and third sets of fans 31, 32, 33. Cables 58 are used to make the interconnection between the connector 56, the first circuit board 50, the controller printed circuit board 52, and the fans 30. The fan tray apparatus 10 described above uses standard size fans 60 to provide an optimal cooling system for an electronic chassis having strict dimensional requirements. The fan tray apparatus 10 may preferably be capable of providing a minimum of 500 cubic feet per minute (CFM) of cooling in an envelope size of approximately 17.250 inches in length, approximately 15 inches in width, and approximately 1.75 inches in height. At the same time, the fan tray apparatus 10 maintains a 60 dBA noise level during normal operation.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A fan tray apparatus comprising:

a mounting body portion having a length and a width, the mounting body portion further including first and second longitudinal sides and first and second lateral sides, a plurality of fans operatively attached to the mounting body portion, the plurality of fans including a first set of fans, a second set of fans, and a third set of fans, the first set of fans positioned along the first lateral side, the second set of fans positioned along the second lateral side, and the third set of fans positioned between the first set of fans and the second set of fans, the third set of fans positioned on a middle portion of the mounting body portion wherein the first set of fans comprises three fans, the second set of fans comprises three fans, and the third set of fans comprises two fans.

2. The fan tray apparatus of claim 1 wherein the third set of fans is spaced apart from the first set of fans a distance that is equal to a distance between the third set of fans and the second set of fans.

3. The fan tray apparatus of claim 1 wherein the third set of fans is spaced apart from the first longitudinal side and the second longitudinal side.

4. The fan tray apparatus of claim 1 wherein each of the plurality of fans is identical.

5. The fan tray apparatus of claim 1 wherein each of the plurality of fans includes a length, a width, and a height.

6. The fan tray apparatus of claim 5 wherein the length of each of the plurality of fans is 120 millimeters, the width of each of the plurality of fans is 120 millimeters, and the height of each of the plurality of fans is 38 millimeters.

7. The fan tray apparatus of claim 1 further comprising:

a first circuit board positioned on the mounting body portion along the second longitudinal side between the first, second, and third sets of fans, the first circuit board including redundant DC/DC converters.

8. The fan tray apparatus of claim 1 further comprising:

a controller printed circuit board for controlling the plurality of fans positioned on the mounting body portion along the first longitudinal side between the first, second, and third sets of fans.

9. The fan tray apparatus of claim 1 further comprising:

a through opening extending through the first longitudinal side, a connector extending through the opening and attached to the first longitudinal side, the connector electrically connected to the plurality of fans.

10. The fan tray apparatus of claim 9 wherein the connector is a floating-blind mate connector.

11. The fan tray apparatus of claim 1 wherein the second longitudinal side includes a pair of manually operable latches.

12. The fan tray apparatus of claim 1 wherein the mounting body portion includes a plurality of grated openings, the plurality of granted openings aligned with the plurality of fans.

13. The fan tray apparatus of claim 1 wherein the mounting body portion includes a plurality of mounting body portion fastener openings spaced apart along the first longitudinal side and the first and second lateral sides.

14. The fan tray apparatus of claim 1 further comprising a cover portion, the cover portion mounted to the mounting body portion.

15. The fan tray apparatus of claim 14 wherein the cover portion includes a plurality of cover fastener openings spaced apart along a perimeter portion of the cover portion, the cover fastener openings aligned with the mounting body portion fastener openings.

16. The fan tray apparatus of claim 14 wherein the cover portion includes a plurality of fan openings, the plurality of fan openings aligned with the plurality of fans.

17. The fan tray apparatus of claim 16 wherein each of the plurality of fan openings is circular.

18. A method of orienting a fan tray apparatus comprising:

providing a mounting body portion having a length and a width, the mounting body portion further including first and second longitudinal sides and first and second lateral sides, a plurality of fans, the plurality of fans including a first set of fans, a second set of fans, and a third set of fans wherein the first set of fans comprises three fans, the second set of fans comprises three fans, and the third set of fans comprises two fans;

attaching the plurality of fans to the mounting body portion;

positioning the first set of fans along the first lateral side;

positioning the second set of fans along the second lateral side;

positioning the third set of fans between the first set of fans and the second set of fans; and positioning the third set of fans on a middle portion of the mounting body portion.

19. A fan tray apparatus comprising:

a mounting body portion having a length and a width, the mounting body portion further including first and second longitudinal sides and first and second lateral sides, a plurality of fans operatively attached to the mounting body portion, the plurality of fans including a first set of fans, a second set of fans, and a third set of fans, the first set of fans positioned along the first lateral side, the second set of fans positioned along the second lateral side, and the third set of fans positioned between the first set of fans and the second set of fans, the third set of fans positioned on a middle portion of the mounting body portion wherein each of the plurality of fans includes a length, a width, and a depth wherein the length of each of the plurality of fans is 120 millimeters, the width of each of the plurality of fans is 120 millimeters, and the depth of each of the plurality of fans is 38 millimeters.

20. A fan tray apparatus comprising:

a mounting body portion having a length and a width, the mounting body portion further including first and second longitudinal sides and first and second lateral sides, a plurality of fans operatively attached to the mounting body portion, the plurality of fans including a first set of fans, a second set of fans, and a third set of fans, the first set of fans positioned along the first lateral side, the second set of fans positioned along the second lateral side, and the third set of fans positioned between the first set of fans and the second set of fans, the third set of fans positioned on a middle portion of the mounting body portion, a first circuit board positioned on the mounting body portion along the second longitudinal side between the first, second, and third sets of fans, the first circuit board including redundant DC/DC converters.

21. A fan tray apparatus comprising:

a mounting body portion having a length and a width, the mounting body portion further including first and second longitudinal sides and first and second lateral sides, a plurality of fans operatively attached to the mounting body portion, the plurality of fans including a first set of fans, a second set of fans, and a third set of fans, the first set of fans positioned along the first lateral side, the second set of fans positioned along the second lateral side, and the third set of fans positioned between the first set of fans and the second set of fans, the third set of fans positioned on a middle portion of the mounting body portion, a controller printed circuit board for controlling the plurality of fans positioned on the mounting body portion along the first longitudinal side between the first, second, and third sets of fans.

* * * * *